US006122390A

United States Patent [19]

Rosswork

[11] Patent Number: 6,122,390

[45] Date of Patent: Sep. 19, 2000

[54] SPEAKER HATCHBOARD

[75] Inventor: Kimber Rosswork, P.O. Box 2526, Crested Butte, Colo. 81224

[73] Assignee: Kimber Rosswork, Crested Butte, Colo.

[21] Appl. No.: 08/909,262

[22] Filed: Aug. 11, 1997

[51] Int. Cl.[7] ..... H04R 25/00

[52] U.S. Cl. ..... 381/386; 381/86; 381/389; 181/149; 181/199; 181/150

[58] Field of Search ..... 181/149, 150, 181/199; 381/86, 386, 388, 389

[56] References Cited

U.S. PATENT DOCUMENTS 2,994,861 8/1961 Reinhardt, Jr. et al. .
4,453,047 6/1984 Thompson ..... 179/146 R
4,489,770 12/1984 Reich, II ..... 150/52 R
4,754,852 7/1988 Mule' et al. ..... 181/149
4,853,966 8/1989 Skrycki ..... 381/188
5,195,445 3/1993 Riddles et al. ..... 114/201 R

*Primary Examiner*—Curtis A. Kuntz
*Assistant Examiner*—Phylesha Dabney
*Attorney, Agent, or Firm*—Holme Roberts & Owen LLP

[57] ABSTRACT

The speaker hatchboard (26) allows audio speakers (34 and 36) to be installed in a sailboat (10) or other vessel without drilling holes through any boat surfaces. The speaker hatchboard (26) includes a body (28) dimensioned to be received within the slots (48) of a hatchway (22) or other boat opening, a pair of openings (30 and 32) for mounting the speakers (34 and 36) and housings (38 and 40) for the speakers (34 and 36). The speaker hatchboard is easily installed and removed by sliding the body (28) up or down within the slots (48).

11 Claims, 4 Drawing Sheets

SPEAKER HATCHBOARD

FIELD OF THE INVENTION

The present invention relates in general to boating and, in particular, to an apparatus for use in installing audio speakers in a boat without the need to puncture any boat surfaces or otherwise potentially compromise watertight surfaces of the boat. The invention is particularly useful for installing speakers in an existing opening such as a hatchway of a sailboat or other vessel.

BACKGROUND OF THE INVENTION

Many boats including, for example, typical sailboats, do not come equipped with radios, stereos or other audio equipment. Owners of such boats, in many cases, would enjoy the opportunity to have battery operated audio equipment installed in their boats. Such audio equipment could provide entertainment, thereby enhancing the boating experience, and could also be used to obtain weather and other information related to boater safety.

Installing such equipment, though, is problematic. In particular, mountings for audio speakers such as designed for automobiles typically include screws, bolts or other fasteners that are designed for attachment to metal or wood frame members. The fasteners are generally attached by drilling into or otherwise penetrating the supporting frame member. Such mounting is undesirable for boat installations for a number of reasons. First, many boat owners are reluctant to drill holes in boat surfaces for fear that they will be unable to adequately seal the holes and water may be allowed to leak into the boat body. In addition, the outer surfaces of boats are commonly formed from wood, fiberglass or other light weight materials that are not well-suited to support weight or that may be prone to cracking, or other damage as a result of drilling installation holes and/or supporting weight. In particular, the outer protective cover or gel coat of fiberglass surfaces is prone to developing cracks that radiate outwardly from puncture holes.

In other cases, speakers are mounted on deck rails or the like where the speakers can snag boat lines or where the speaker wires may get in the way. In addition, such rail mountings generally do not allow for easy speaker repositioning and are typically directed only to deck area entertainment. Moreover, it is desirable that boat speakers be installed for easy removal because speakers may be damaged due to continuous exposure to the elements. Easy removal would also facilitate secure storage, thereby reducing opportunities for theft or vandalism.

SUMMARY OF THE INVENTION

The present invention is directed to an apparatus for use in installing audio speakers in a boat without the need to penetrate any of the boat's watertight surfaces. According to the present invention, speakers are mounted in an existing opening of the boat such as a port, a window, or a hatchway or other cabin entrances using a support structure fitted to the opening. In this manner, speakers can be secured in place easily and without compromising the integrity of any watertight surfaces. In addition, the speakers can be readily removed between uses for storage in the cabin or another protected location and can be respositioned for deck or cabin area use. Moreover, the speakers are mounted out-of-the-way, thus minimizing the potential for interference with boat lines while sailing. When the speakers are removed, the opening can be covered in the normal fashion to enclose and lock the cabin as desired.

According to one aspect of the present invention, the apparatus includes a support structure dimensioned to be received within the boat opening, mounting structure for use in mounting at least one audio speaker within the support structure, and securing structure for securing the support structure in the boat opening without penetrating any watertight surface of the boat. The support structure, mounting structure and securing structure can be integrally formed or can be separately formed and interconnected. The support structure is formed from wood such as teak or other material having sufficient strength to support one or more audio speakers and resistance to degradation in a marine environment. The mounting structure preferably defines an opening dimension to receive an audio speaker and further defines a mounting surface for interfacing with a mounting plate, or the like of the audio speaker. The securing structure secures the support structure to walls of the boat opening by suitable non-penetrative means such as pressure or friction fitting, or mating engagement between the securing structure and the opening walls, e.g., extension of the securing structure into slots formed in the opening walls. The height, width and angles of the securing structure edges may be made adjustable by telescoping/hinging structure or the like to accommodate installation in boat openings of varying dimensions.

According to another aspect of the present invention, an apparatus is provided for installing speakers in a hatchway between a cabin and a deck of a boat, where the edges of the hatchway includes slots for receiving hatchboards to enclose the cabin. The apparatus includes a first portion dimensioned to be received within the first slot, a second portion dimensioned to be received within the second slot, support structure for substantially rigidly interconnecting the first and second portions, and a speaker mount for use in mounting the speaker to the support structure. The apparatus can further include a housing for housing the speaker when mounted. In one embodiment, the hatchway has a width that tapers from top to bottom of the hatchway, and the apparatus is formed as an integral body that is installed by sliding the body downwardly in the hatchway slots until the apparatus body butts up against the slot walls and/or contacts the bottom of the hatchway. In this embodiment, the first and second apparatus portions are defined by side edge sections of the integral body, the support structure is defined by the body area between the side edges, and the speaker mount can be a port formed in the body for receiving the speaker or speakers. It will be appreciated that the apparatus can be reversed to provide sound in the deck area or the cabin area.

DESCRIPTION OF THE DRAWINGS

For a more complete understanding of the present invention and further advantages thereof, reference is now made to the following Detailed Description, taken in conjunction with the drawings, in which.

DETAILED DESCRIPTION

The present invention allows audio speakers to be installed in a boat without drilling holes or otherwise penetrating any boat surfaces. The apparatus of the invention can be dimensioned (or dimensionally adjustable) for installation in a variety of types of openings and in a variety of types of boats. The invention is set forth below in the context of a speaker hatchboard for installation in the hatchway of a sailboat. This application is particularly advantageous as the relevant boat/apparatus geometry allows for simple and secure installation and removal of audio speakers without unduly impeding passage through the hatchway, and provides speakers at a desirable location adjacent to the boat's deck area or, by reversing the installation, adjacent to the cabin area. In the following description, the relevant sailboat structure is first described in connection with FIGS. 1 and 2. Thereafter, the speaker hatchboard of the present invention and installation are described in connection with FIGS. 3–5.

Figure 1:
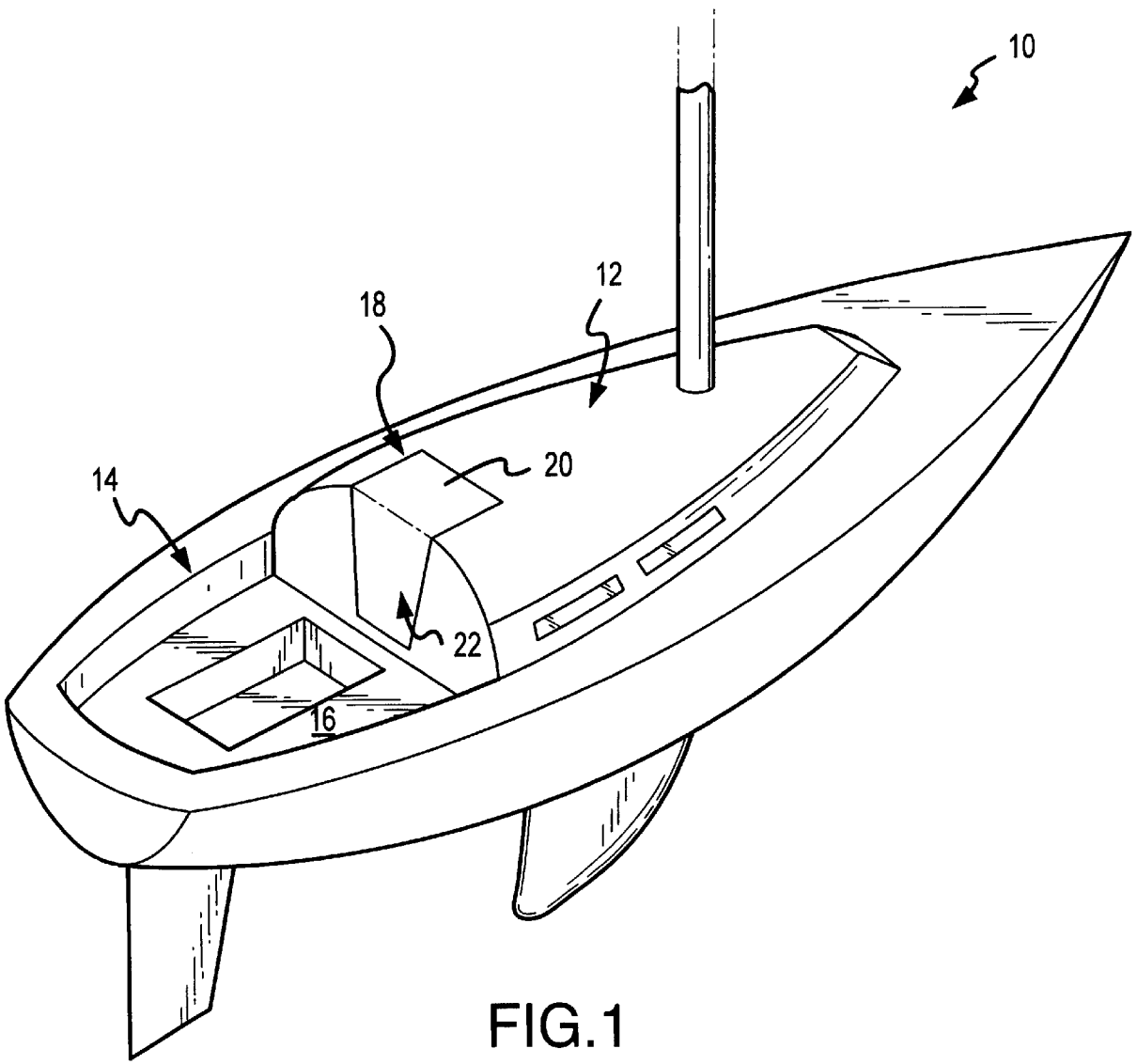
FIG. 1 is a perspective view of a sailboat in which the speaker hatchboard of the present invention may be installed.
Figure 2:
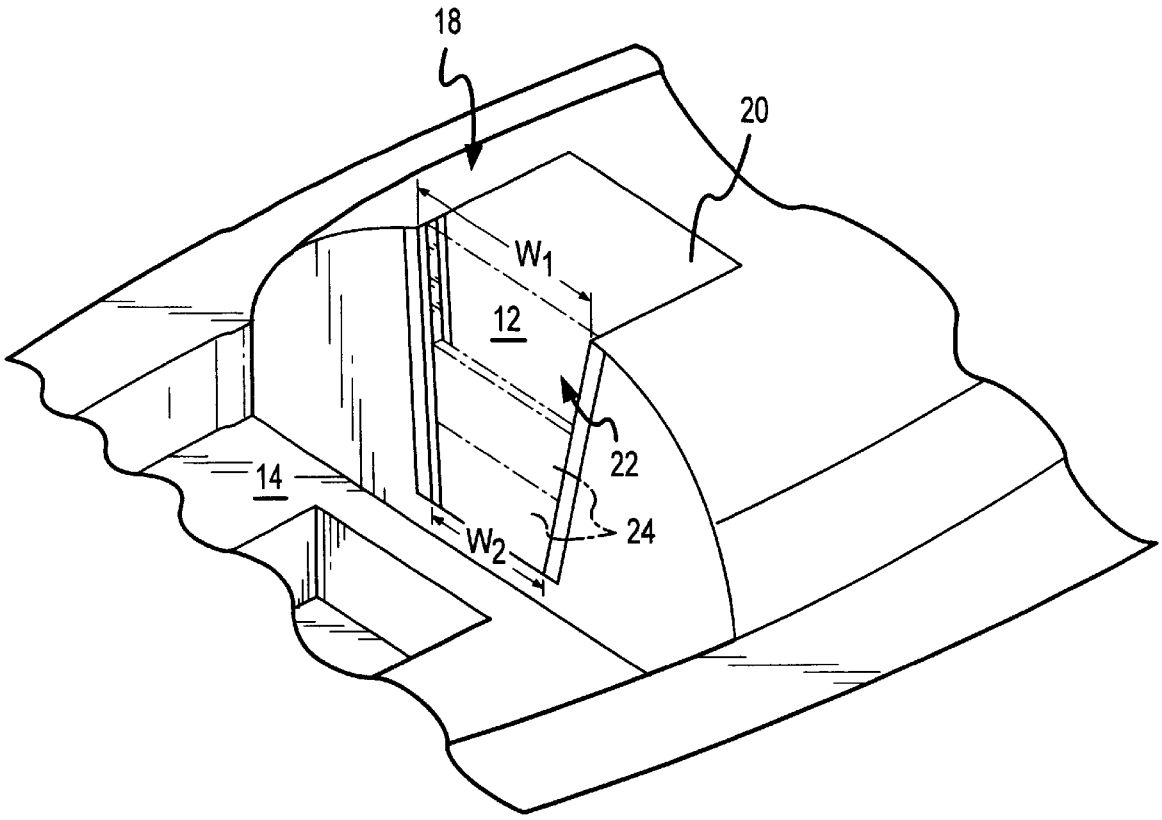
FIG. 2 is a perspective view of a hatchway area of the sailboat of FIG. 1.

Referring to FIGS. 1 and 2, a sailboat, in which the speaker hatchboard of the present invention may be installed, is generally identified by the reference numeral 10. In relevant part, the sailboat 10 includes a covered cabin area 12 and a deck area 14 with seating 16. The cabin area 12 and deck area 14 are separated by a hatch 18. The illustrated hatch 18 includes an upper sliding hatch 20 and a hatchway portion 22 for allowing passage between the cabin area 12 and deck area 14. The illustrated hatchway portion 22 continually tapers from a maximum width $W_1$ at the top end to a minimum width $W_2$ at the bottom end. In order to enclose and lock the cabin area 12, a series of stacked hatchboards can be inserted into slots provided in the sides of the hatchway portion 22. Two such stacked hatchboards 24 are shown in phantom in FIG. 2. The various hatchboards 24 are dimensioned to fit securely into specific areas of the tapered hatchway portion 22. As will be understood from the description below, the hatchway slots are used according to the present invention for installation of audio speakers without the need to drill holes in the sailboat 10.

Figure 3:
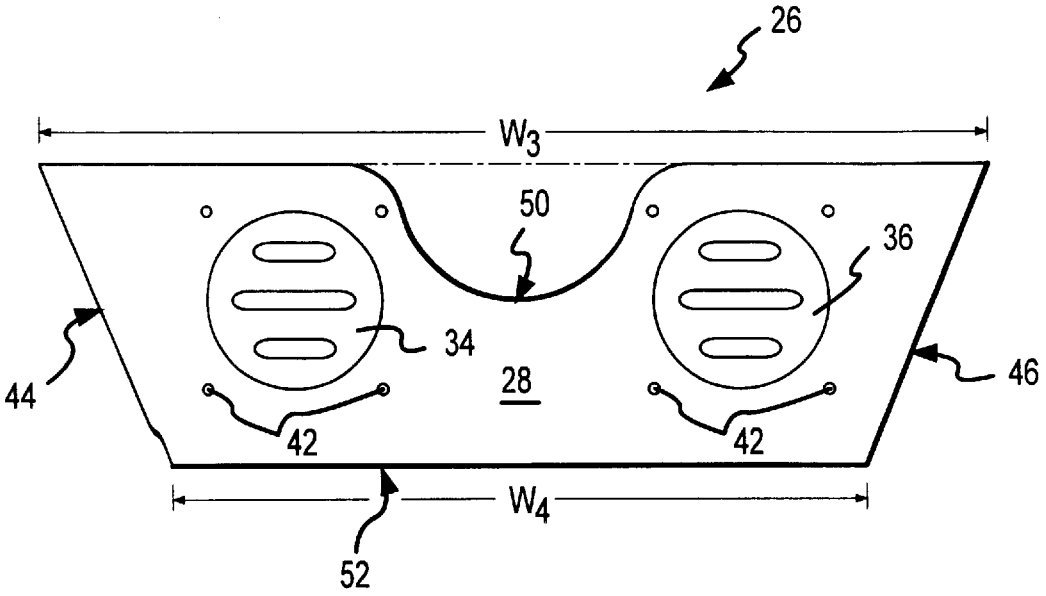
FIG. 3 is a front view of a speaker hatchboard in accordance with the present invention.
Figure 4:
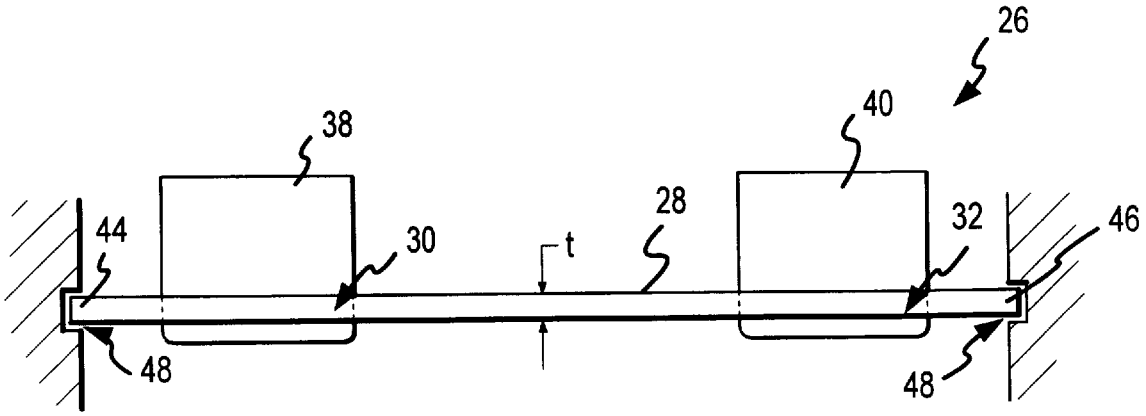
FIG. 4 is a top view of the speaker hatchboard of FIG. 3.
Figure 5:
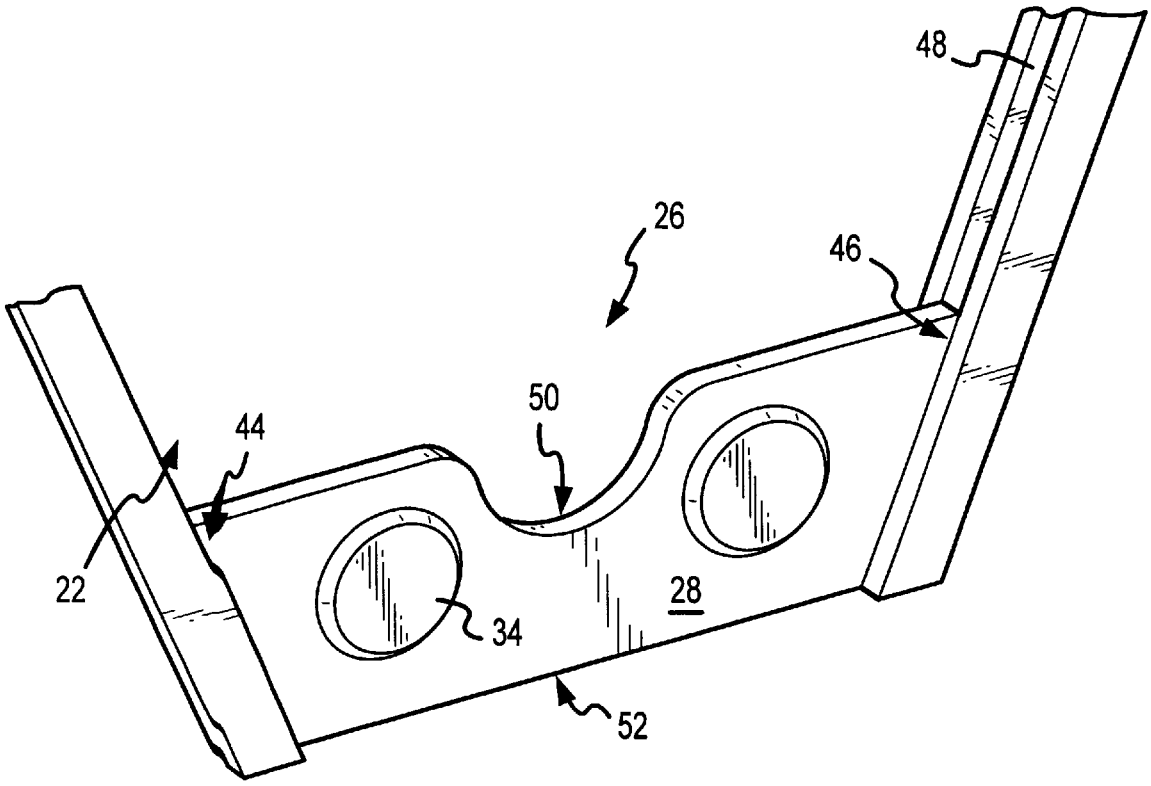
FIG. 5 is a perspective view showing the speaker hatchboard of FIG. 3 installed in the hatchway of the sailboat of FIG. 1.

The speaker hatchboard 26 of the present invention is shown in FIGS. 3–5. Generally, the speaker hatchboard 26 comprises a generally trapezoidal body 28 having two openings 30 and 32 dimensioned to receive two marine speakers 34 and 36, respectively, and a pair of housings 38 and 40 for enclosing the speakers 34 and 36. The body 28 and housings 38 and 40 can be formed from any suitable material. In the illustrated embodiment the body 28 and housings 38 and 40 are formed from wood that has been suitably protected against the elements by paint, stain, waterproofing treatment or the like. Teak is a preferred material because of its resistance to degradation in marine environments including salt water and its pleasing appearance that compliments most boat decors. It will be appreciated that the body 28 and housings 38 and 40 could alternatively be formed from plastic, fiberglass, metal, or a variety of other materials. The illustrated housings 38 and 40 are attached to the body 28 by screws 42 or other fasteners.

As previously noted, the body 28 has a generally trapezoidal shape. The trapezoidal shape is defined in part by side edges 44 and 46 that are angled to generally match the shape of the boat's tapered hatchway portion 22 (FIGS. 1–2). The body 28 has a maximum width $W_3$ that is between the minimum and maximum widths, $W_1$ and $W_2$, respectively (FIG. 2), of the hatchway portion 22. Preferably, the minimum width $W_4$ of the body 28 is approximately the same as minimum width $W_2$ of the hatchway portion 22 such that the speaker hatchboard 26 can be positioned at the bottom of the hatchway portion 22, thereby facilitating passage between the cabin area 12 and deck area 14 when the speaker hatchboard 26 is installed, with minimal risk of entanglement with speaker cords which extend through openings in the speaker housings 38 and 40. Alternatively, a body of a speaker hatchboard could be constructed so as to have a telescoping or otherwise adjustable width (or height) to accommodate boat openings of varying dimensions. Similarly, a pivoting hatchboard edge structure could be provided to accommodate various angled openings. If desired, quick release speaker wire terminals may be provided on the outside of the housings 38 and 40 for ease of installation and removal/storage.

The thickness t of the body 28 is selected to fit securely within slots 48 of the hatchway portion 22 and allow for sliding motion of the body 28 within slots 48 for installation and removal. The body 28 optionally includes a narrowed area 50 between the speakers 34 and 36 to further facilitate passage between the cabin area 12 and deck area 14 when the speaker hatchboard 26 is installed. The body is shown without such a tapered area in phantom in FIG. 3.

The speaker hatchboard 26 is installed by aligning the body 28 with the slots 48 in an area of the hatchway portion 22 where the width of the hatchway portion 22 is greater than the width of the body 28. The speakers 34 and 36 may be directed towards the cabin area 12 or deck area 14 as desired. The speaker hatchboard 26 is then progressively lowered so that the edges 44 and 46 of the body are received within the slots 48, until the edges 44 and 46 butt up against the sidewalls of slots 48 and/or the bottom edge 52 butts against the bottom of hatchway portion 22.

It will be appreciated that, depending on the relative dimensions of the hatchway portion 22 and speaker hatchboard 26, the speaker hatchboard 26 may be installed at the bottom, slightly above the bottom, or other position within the hatchway portion 22. In any case, the speaker hatchboard is secured in place by contact between one or more of the edges of speaker hatchboard 26 and one or more edges of the hatchway portion 22, and by the weight of the speakers 34 and 36 and speaker hatchboard 26, without the need to drill any installation holes in sailboat 10.

While various implementations of the present invention have been described in detail, it is apparent that further modifications and adaptions of the invention will occur to those skilled in the art. However, it is to be expressly understood that such modifications and adaptations are within the spirit and scope of the present invention.

What is claimed is:

1. An apparatus for use in installing at least one audio speaker in an existing opening in a watertight surface of a boat such that the watertight surface of the boat is left intact, said watertight surface including peripheral structure defining said boat opening, said apparatus comprising:

support means for supporting said audio speakers, said support means being dimensioned to be received within said peripheral structure of said watertight surface defining said boat opening;

securing means, associated with said support means, for securing said audio speakers to said support means; and mounting means, associated with said support means, for mounting said support means within said opening in said watertight surface of said boat free from penetration of said watertight surface, whereby said speakers can be installed in said opening without compromising the integrity of the boat's watertight structure, said mounting means comprising an interface structure, associated with said support means, for contacting said peripheral structure of said watertight surface defining said boat opening such that the support means is secured in place by contact between said interface structure and said peripheral structure, wherein said support means has a top, a bottom and sides, said sides being tapered to define a decreasing support means width from top to bottom whereby said support means can be received within a tapered portion of said opening.

2. An apparatus as set forth in claim 1, wherein said opening comprises a hatch and support means is dimensioned to be slidably received within a hatchboard slot.

3. An apparatus as set forth in claim 1, wherein said support means is formed of wood and has a dimension that substantially matches a dimension of a hatchboard of said boat.

4. An apparatus as set forth in claim 1, wherein said securing means comprises structure defining a support opening in said support means, wherein said opening is dimensioned to receive said speaker.

5. An apparatus as set forth in claim 4, wherein said support opening is dimensioned so as to provide an interface between said structure and a mounting surface of said speaker.

6. An apparatus as set forth in claim 1, wherein said mounting means comprises an integral portion of said support means.

7. An apparatus as set forth in claim 1, wherein said mounting means comprises an edge portion of said support means dimensioned to be securely received within said opening of said watertight surface.

8. An apparatus as set forth in claim 1, further comprising housing means interconnected to said support means, for housing said speaker.

9. An apparatus for use in installing at least one audio speaker in an existing opening in a watertight surface of a boat such that the watertight surface of the boat is left intact, comprising:

support means for supporting said audio speakers, said support means being dimensioned to be received within said boat opening;

securing means, associated with said support means, for securing said audio speakers to said support means; and mounting means, associated with said support means, for mounting said support means within said opening in said watertight surface of said boat free from penetration of said watertight surface, whereby said speakers can be installed in said opening without comprising the integrity of the boat's watertight structure;

wherein said opening comprises a passageway and said support means is adapted to be received within a lower portion of said passageway, said support means having left and right openings for receiving left and right speakers, respectively, and further having a reduced height area disposed between said left and right openings for facilitating passage via said passageway over said support means.

10. An apparatus for use in installing at least one audio speaker in a boat, said boat including a cabin area and a deck area separated by a hatchway wherein said hatchway includes at least first and second channels disposed on edges of said hatchway for removably receiving at least one hatchboard therein such that said cabin area can be selectively enclosed, said assembly comprising:

a first portion dimensioned to be received within said first channel;

a second portion dimensioned to be received within said second channel;

a support structure for substantially rigidly interconnecting said first portion and said second portion; and speaker mounting means, associated with said support structure, for receiving said speaker such that said speaker can be secured to said support structure;

wherein said hatchway has a first width at an upper portion thereof and a second width, less than said first width, at a lower portion thereof, and said support structure defines a third width between said first and second portions wherein said third width is between said first and second widths.

11. An apparatus as set forth in claim 10, further comprising a housing, interconnected to said support structure, for housing said speaker.

* * * * *